United States Patent [19]

Sorkilmo

[11] Patent Number: 5,067,334

[45] Date of Patent: Nov. 26, 1991

[54] DOOR LOCK SECURITY DEVICE

[76] Inventor: Clayton O. Sorkilmo, 5447 - 72nd Cir. North, Brooklyn Center, Minn. 55429

[21] Appl. No.: 604,971

[22] Filed: Oct. 29, 1990

[51] Int. Cl.[5] ..... E05B 17/00

[52] U.S. Cl. ..... 70/416; 70/211

[58] Field of Search ..... 70/416, 210, 211, 431; 292/342, 343, 92

[56] References Cited

U.S. PATENT DOCUMENTS

| | | | |
|---|---|---|---|
| 1,939,402 | 12/1933 | Moser | 292/343 |
| 4,185,403 | 1/1980 | Lupton | 70/416 |
| 4,885,921 | 12/1989 | Sharav | 70/159 |

*Primary Examiner*—Robert L. Wolfe

*Attorney, Agent, or Firm*—Clayton R. Johnson

[57] ABSTRACT

The dead bolt lock assembly includes a lock cylinder mounted by the door and extending into the room interior and having a lock handle with a cross bar portion. A security device has an end portion having a longitudinal notch opening through the terminal transverse edge thereof to proved to longitidinally extending legs. The legs have opposite longitudinal surfaces that converge in a direction toward the terminal edge, the surface of the legs most closely adjacent the lock cylinder when in use having transverse ribs extending away therefrom. The legs are extendable between the cross bar and the lock cylinder housing until the legs are in binding engagement therewith prevent the lock handle from rotating and thus prevent one from unlocking the door outside of the room using the right key for unlocking the door. The above mentioned surfaces are planar.

10 Claims, 1 Drawing Sheet

DOOR LOCK SECURITY DEVICE

BACKGROUND OF THE INVENTION

Security apparatus for preventing a dead bolt lock apparatus being unlocked from the outside of a door.

In my U.S. Pat. No. 4,951,982, there is disclosed a security member removably positionable between an interior portion of a lock housing and a dead bolt handle to prevent movement of the dead bolt from its locked position by one exterior of the room using a proper key. The security member includes a device having a first end portion with a pair of legs that are extendable under the lock handle cross bar and are tapered to be of a height that progressively increases in a direction toward the second end portion, the second end portion having a generally planar door facing surface coextensive with the first end portion planar door facing surface. An adjustment member is mounted by the second end portion and has a foot abutable against the lock to vary the angle of the device door facing surface relative to the lock.

In U.S. Pat. No. 4,279,137 to Cook there is disclosed security mechanism that includes a plate having a downwardly opening notch to have the dead bolt lock handle extended therethrough. Struts are mounted by the plate to prevent the lock handle being turned by one using a key outside of the door when the door handle extends through the notch. Dominguez, U.S. Pat. No. 3,585,827, functions in a manner somewhat similar to that disclosed by Cook.

In U.S. Pat. No. 3,263,464 to Suroff et al there is disclosed a locking device that includes a lock having a generally rectangular lock block located inside a room and a lock actuator within the room that is turned when using a key outside of the room. A somewhat U-shaped base has a lower leg to abut against the block lower edge, a second leg adapted to abut against the upper edge of the block, a pair of adjustment screws mounted by the second leg and adapted to be turned for adjusting the spacing of the second leg from the block, and a recess for receiving the lock actuator therein to prevent the lock actuator rotating when it is attempted to unlock the door from outside of the room. One of the limitations of this type apparatus is that if the lock does not have a rectangular block extending into the room, the apparatus can not be used in a manner suggested by this patent.

Anderson 689,152 discloses a plate having a curved portion that is inclined at an angle to limit the degree of opening of a door. A screw is threaded into the plate and has its lower end mounting a foot to abut against the floor. By turning the screw the angle of the plate relative to the floor can be increased above that provided by the curve portion.

Albright, U.S. Pat. No. 1,338,205, discloses a door check having downwardly extending teeth to engage the floor vertically opposite and a substantial distance longitudinally remote from where the door engages the door check, while Bellamy, 776,378, discloses a door check having serrations along the longitudinal length of the vertical plates thereof and an adjustment device for vertically elevating the plate end portion opposite where the plates engage the door.

In order to provide a simpler, more inexpensive devices for door locks than that disclosed in the above mentioned prior art, this invention has been made.

SUMMARY OF THE INVENTION

The security device includes security device legs adapted to be located on opposite sides of the shaft portion of a dead bolt lock handle that extends into the room and have a tapered surface for abutting against the finger operated portion of the lock handle when the device has its end portion opposite the legs is pushed to its most closely adjacent position to the finger operated portion. In such a position the inclined surfaces of the legs in abutting against the finger operated portion prevent the finger operated portion rotating to unlock the door. The shaft portion extends through the notch formed by the legs.

One of the objects of this invention is to provide new and novel security mechanism for blocking the unlocking of a door from the outside by one using a key that would otherwise unlock the door. An additional object of the invention is to provide new and novel means that cooperates with the interior lock handle that operates a dead bolt lock and the lock cylinder that is relatively inexpensive and easy to manufacture for selectively preventing one from unlocking the door from outside of the room.

BRIEF DESCRIPTION OF THE DRAWINGS

As shown in FIG. 1, the security device of this invention, generally designated 20, is used for preventing the unlocking a dead bolt lock, generally designated B, from outside of the room, even when using the right key. The dead bolt lock B is mounted by the door 10 and has the dead bolt 11 extendable into a well 12 formed in the door frame 13 of the room. The dead bolt lock also includes a lock cylinder or housing !5 mounted by the door, usually adjacent to the door handle 14, but spaced therefrom. The housing frequently, but not always, extends away from the adjacent part of the door and further into the room than the adjacent door panel when the door is closed.

Figure 1:
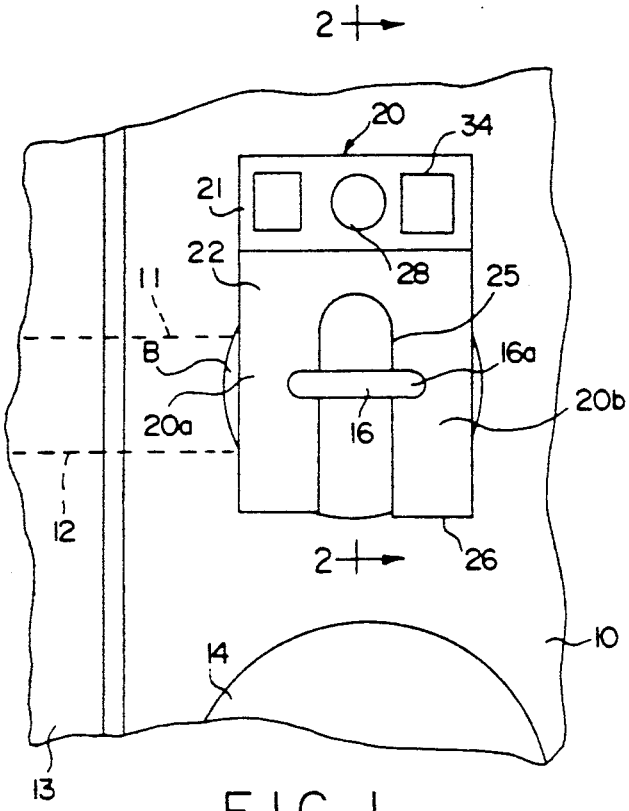
FIG. 1 is a fragmentary front view of the door and door frame adjacent to the door handle and dead bolt lock together with the door lock security device of this invention in use for preventing the dead bolt lock being unlocked from outside of the room.
Figure 2:
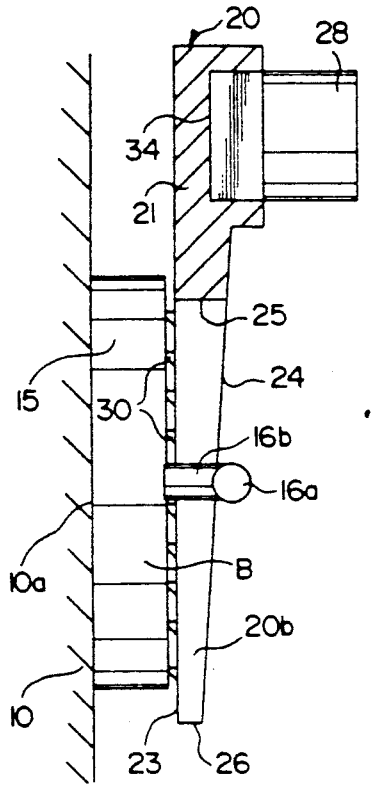
FIG. 2 is a cross sectional generally taken and along the lines and in the direction of the arrows 2—2 of FIG. 1 with the lock assembly in a in a locked position.
Figure 3:
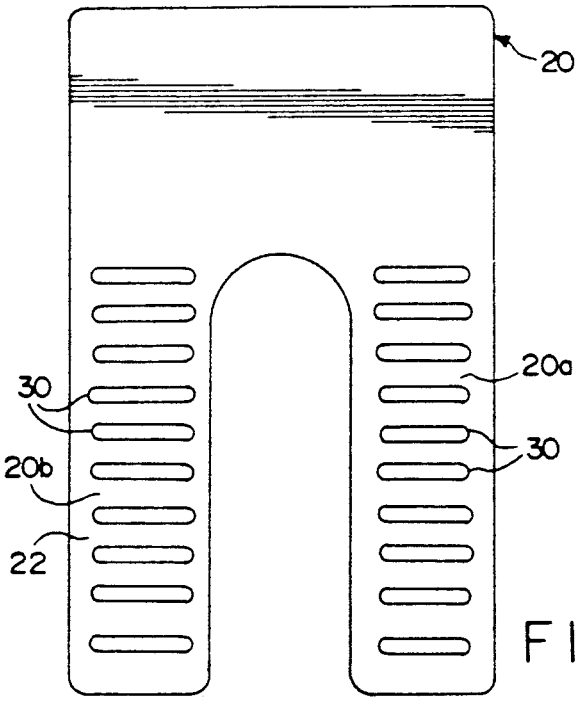
FIG. 3 is back view of the lock security device of FIG. 1, the height of the ribs relative to that of the legs being exaggerated to facilitate the illustration thereof.

The housing mounts conventional mechanism (not shown) that is operated by the dead bolt handle lock actuator or operator handle 16 that extends into the room and is mounted by the housing. The dead bolt handle frequently has a generally horizontal shaft portion **16*b* and a cross bar portion 16*a* mounted by portion 16*b* in spaced relationship to the door. Even though portion 16*a* has been referred to as a cross bar, it is to be understood that it may be of other shapes, for example, generally of a disk shape that is of a larger diameter than the shaft portion. Also the distance that the cross bar portion is spaced from the door and the distance that the housing extends away from the door, if any, varies, depending upon the make of the lock, or may not be exposed through door surface 10*a***.

The longitudinally elongated security device 20 has a block portion 21 and a plate portion 22 joined to the block portion to extend longitudinally away therefrom and advantageously of a maximum thickness substantially less than that of the block portion. The plate and block portions are joined to form a continuous planar door facing surface 23. Opposite of surface 23, the plate portion 22 has a tapered surface 24 that intersects with the block portion, extends a shorter distance away from the surface 23 than the block portion extends away from the surface 23 and converges toward the surface 23 in a direction away from the block portion.

The plate portion has a generally U-shaped notch 25 that opens to the terminal transverse edge 26 of the plate portion that is opposite of the block portion and through the surfaces 23, 24 to form elongated legs 20*a*, 20*b* that are spaced sufficiently to have the shaft portion of dead bolt handle extend therethrough, but less than the maximum dimension of portion 16*a* that extends transverse to the shaft. Advantageously, as in part may be seen from FIG. 1, even if the shaft portion of the dead handle were in abutting relationship to the web portion of the wall defining the notch 25, legs 20*a*, 20*b* are not of a sufficient longitudinally length to abut against the door knob. The length of the plate portion is substantially greater than the corresponding dimension of the notch and is substantially greater than the dimension at right angles thereto, i.e. width of each of the surfaces 23. 24. Advantageously, the transverse dimension of each of the legs is about the same as that of the notch along at least a major portion of the length of the notch.

Each of the legs has transverse ribs 30 extending away form the surface 23 to decrease the possibility of the security device 20 moving relative to the lock surface when the device is in use. The ribs are longitudinally spaced and are transversely elongated to extend generally perpendicular to the direction the device 20 is moved toward its position for blocking rotation of the lock handle 16. When in use the ribs abut against the lock cylinder interior surface, provided the cylinder extends closely adjacent to the door surface 10*a* or further into the room than the surface 10*a*. The ribs need be provided only on the legs since this is the only portion of device that is directly and nearly directly opposite the surface portion against which the cross bar 16*a* abuts when the device is in its position to prevent the lock handle from rotating.

A cylindrical knob 28 is joined to the block portion 21 in a central location to extend away from the surface of the block portion that is opposite surface 23. The knob facilitates manually placing and removing the security device with reference to lock handle 16. Advantageously, the block portion is provided with a recess 34 on transverse opposite sides of the knob to decrease the amount of material used in making the device 20, particularly when the device is made of molded plastic.

In using the security device 20, the device legs are extended between the handle cross bar portion 16*a* and the lock cylinder 15. Then the device is moved downwardly with the lock handle shaft extending in the notch until the device legs are wedged between the handle portion 16*a* and the lock cylinder in binding relationship therewith to prevent rotation of the dead bolt handle portion by one turning a key outside of the room in an attempt to obtain access to the room. The spacing of the web portion of the notch from the shaft portion 16*b* depends in part upon the distance that the lock housing extends away from the door surface, if any, the diameter of the housing, the spacing of the cross bar portion 16*a* from the housing, and the angle of taper and thickness of the tapered portion 20*a*, 20*b*. Advantageously the longitudinal tapering of the legs relative to the surface 23 is about 5–15 degrees.

During use, preferably the block portion is located above the dead bolt handle whereby gravitational forces would tend to increase the wedging action of the tapered surface against the cross bar. The tapered surface portion of one of the legs 20*a* and 20*b* would exert a greater wedging if the dead bolt handle would tend to rotate in one direction while the other leg would similarly function if the handle tended to rotate in the opposite direction. In the event that the dead bolt lock is of a type that the lock housing does not extend through the door surface 10*a*, than during use, at least many of the ribs and possibly the surface 23 would abut against the door surface 10*a*.

As one example of the invention but not otherwise as a limitation thereon, for a device of a longitudinal length of about 5.7 cm, the notch may be of a longitudinal length of about 3.7 cm, the spacing of the ribs about 0.2 cm, the longitudinal dimension of the ribs about 0.05 cm, the transverse dimension of a rib about 0.9 cm, and the number of ribs on each legs about 12.

What is claimed is:

1. In combination with a door, the door having an interior surface, a door knob mounted by the door and extending inwardly of the door interior surface and a dead bolt lock mounted by the door and having a lock housing mounted by the door, and a dead bolt handle rotatably mounted by the housing and having a shaft portion extending away from the door interior surface and a cross bar portion that is of a larger transverse dimension than the shaft portion and joined to the shaft portion remote from the door interior surface, and a longitudinally elongated security member removably mounted on the door and at least in part mounted by the dead bolt lock, the security member having a first surface, a first longitudinally elongated end portion having at least part of the first surface, and a second end portion joined to the first end portion to extend longitudinally away therefrom, the second end portion having a second surface opposite from the first surface for abutting against the cross bar portion, the second end portion having a first transverse terminal edge longitudinally opposite of the first end portion and a longitudinally extending notch opening through said member surfaces and to the transverse edge for having the dead bolt handle shaft portion extended therethrough, and ribs joined to the first surface to extend away therefrom in a direction opposite the second surface for abutting against the door interior surface to decrease the possibility of the security member moving relative to the door interior surface.

2. The apparatus of claim 1, wherein the notch separates the second end portion into two legs that extend at least a major portion of the longitudinal length of the second end portion.

3. The apparats of claim 2 wherein only the legs have the ribs.

4. The apparatus of claim 2, wherein the ribs are transversely elongated and longitudinally spaced from one another, and are provided on the legs.

5. The apparatus of claim 2, wherein a cylindrical knob is fixed to the first end portion opposite the first surface to extend away therefrom to facilitate manually moving the device to and from a position that the legs extend between the cross bar and the cylinder knob.

6. The apparatus of claim 2, wherein the legs have the ribs joined thereto and the transverse width of each of the legs and the notch is about the same for at least a major portion of the length of the legs and notches.

7. The apparatus of claim 6, wherein the maximum thickness dimension of the second end portion is substantially less than the maximum dimension of the first end portion.

8. Door lock security apparatus for a door having an interior surface and that mounts a door knob, and a security lock mounted by the door and having a lock housing and a lock operator handle mounted by the housing and having a shaft portion extending away from the door interior surface and a cross bar portion that has a larger transverse dimension than a corresponding dimension of the shaft portion, the cross bar portion being joined to the shaft portion remote from the interior surface and being rotatable between an unlocked and a locked position, comprising a longitudinally elongated security member having a first longitudinal end portion, a second longitudinal end portion joined to the first end portion to extend longitudinally away therefrom, the first and second end portions having a generally planar, coextensive first surface extending the longitudinally length of the first and second end portions, the second end portion having a terminal transverse edge remote from the juncture of the first and second end portions and a second surface opposite of the first surface, the second end portion having a maximum thickness dimension between said surfaces that is less than the corresponding dimension of the first end portion and a longitudinally elongated notch of a transverse dimension to have the lock shaft extend therethrough and less than the maximum transverse dimension of the cross bar in its locked position, is transversely centered and opens through said surfaces and the transverse edge to form two transversely spaced longitudinally elongated legs that are extendable between the cross bar in its locked position and at least one of the door interior surface and the lock housing and a plurality of transversely elongated, longitudinally space ribs joined to the first surface to extend away therefrom in a direction opposite the second surface, the ribs being provided on the legs.

9. The apparatus of claim 8, wherein the legs along said device surfaces converge in a direction toward the terminal edge.

10. In combination with a door, the door having an interior surface, a door knob mounted by the door and extending inwardly of the door interior surface and a dead bolt lock mounted by the door and having a lock housing mounted by the door, and a dead bolt handle rotatably mounted by the housing and having a shaft portion extending away from the door interior surface and a cross bar portion that is of a larger transverse dimension than the shaft portion and joined to the shaft portion remote from the door interior surface, and a longitudinally elongated security member removably mounted on the door and at least in part mounted by the dead bolt lock, the security member having a first surface, a first longitudinally elongated end portion having at least part of the first surface, and a second end portion joined to the first end portion to extend longitudinally away therefrom, the second end portion having a second surface opposite from the first surface for abutting against the cross bar portion, the second end portion having a first transverse terminal edge longitudinally opposite of the first end portion and a longitudinally extending notch opening through said member surfaces and to the transverse edge for having the dead bolt handle shaft portion extended therethrough, and transverse ribs joined to first surface to extend away therefrom in a direction opposite the second surface for abutting against the door interior surface to decrease the possibility of the security member moving relative to the interior door surface when the cross bar portion abuts against the second surface, at least some of the ribs having the notch extending transversely therebetween.

* * * * *